United States Patent [19]

Alderman

[11] 4,244,785

[45] Jan. 13, 1981

[54] METHOD FOR OPERATING A BATTERY OF COKE OVENS

[76] Inventor: Lewis Alderman, 254 Sylvan Ave., Scarborough, Ontario M1E 1A6, Canada

[21] Appl. No.: 917,706

[22] Filed: Jun. 21, 1978 (Under 37 CFR 1.47)

[51] Int. Cl.[3] ..... C10B 57/00; C10B 27/04

[52] U.S. Cl. ..... 201/41; 202/257; 202/263

[58] Field of Search ..... 201/4, 29, 26, 41; 202/254, 255, 256, 257, 258, 259, 260, 261, 263

[56] References Cited

U.S. PATENT DOCUMENTS

| | | | |
|---|---|---|---|
| 1,376,313 | 4/1921 | Becker | 202/263 |
| 1,798,517 | 3/1931 | Becker | 202/263 |
| 1,849,197 | 3/1932 | Miller | 201/4 X |
| 2,692,849 | 10/1954 | Hyde | 201/4 |
| 2,975,109 | 3/1961 | Van Ackeren | 202/255 X |
| 3,309,286 | 3/1967 | Alderman | 202/254 X |
| 3,764,482 | 10/1973 | Yoshida et al. | 202/263 X |
| 4,010,079 | 3/1977 | Faber | 201/4 |
| 4,105,503 | 8/1978 | Bruce | 202/255 X |
| 4,110,168 | 8/1978 | Brice | 201/4 |

FOREIGN PATENT DOCUMENTS

| | | | |
|---|---|---|---|
| 1192776 | 2/1971 | Fed. Rep. of Germany | 201/41 |

*Primary Examiner*—Frank W. Lutter
*Assistant Examiner*—Roger F. Phillips
*Attorney, Agent, or Firm*—Thomas H. Murray; Clifford A. Poff

[57] ABSTRACT

Charging gases from each coking chamber in a battery of coke ovens are withdrawn through a closable ascension pipe into only a first gas main. The gases liberated during carbonization of the coal charge in each oven chamber are withdrawn through a closable ascension pipe into only a second gas main throughout the remainder of the carbonization process. The gases in each gas main are sprayed with flushing liquor. Gases are continuously transferred from the second gas main through pipes into the first gas main to equalize the gas pressure within the gas mains. Flushing liquor removed from the first gas main is processed to remove the tar content therefrom and to provide a clear flushing liquor which is used to spray charging gases within the first gas main. Gases and flushing liquor removed from the second gas main undergo separation whereupon the gas phase is discharged for further processing and the liquid phase undergoes separation to remove solids and tars therefrom, thus providing clear flushing liquor for reuse to spray gases in the second gas main.

9 Claims, 1 Drawing Figure

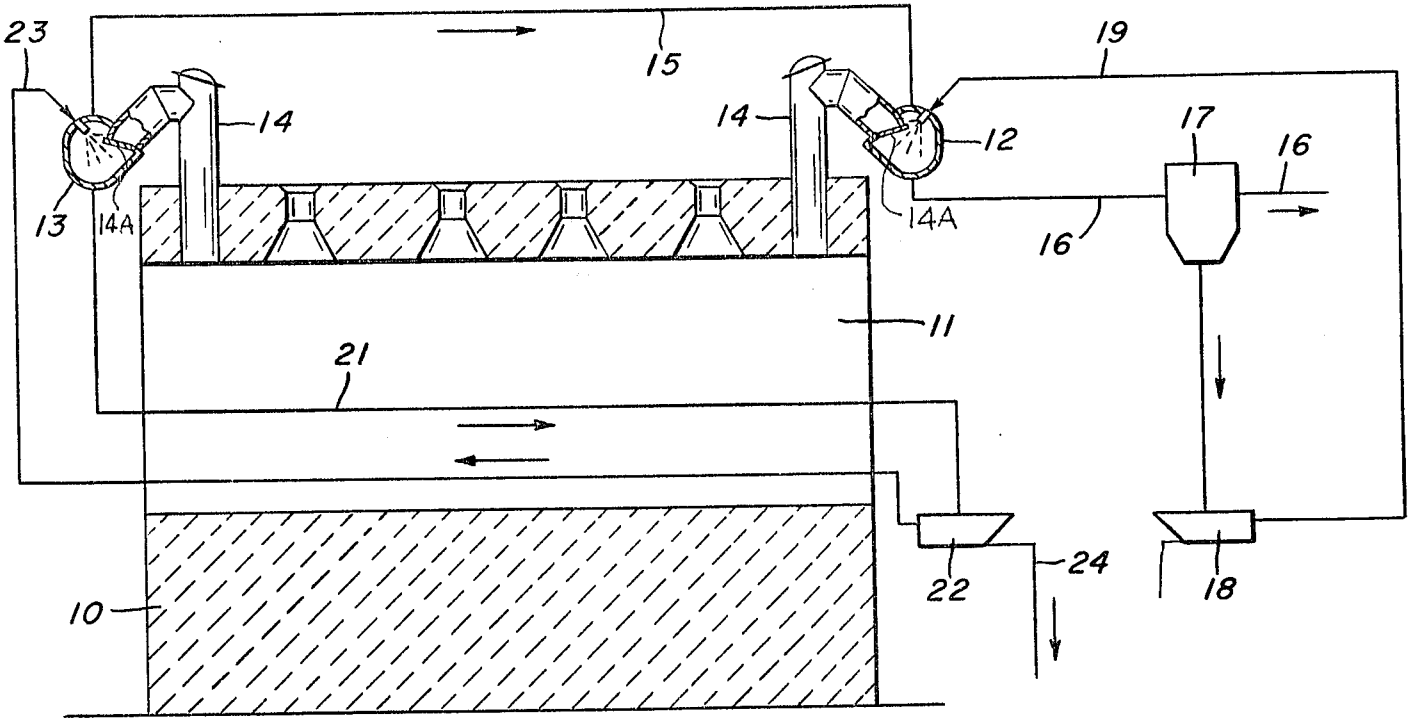
16
17
18
19
16
24
12
14A
11
22
14
15
21
14
14A
13
23
10

METHOD FOR OPERATING A BATTERY OF COKE OVENS

BACKGROUND OF THE INVENTION

This invention relates to a method of operating a battery of coke ovens wherein the oven chambers are adapted to communicate through closable ascension pipes with two gas mains that extend along the battery of coke ovens and incorporate sprays to cool the gases therein, the arrangement being such that charging gases from the coke oven chambers are conducted only into the first gas main during the charging of dried and preheated coal and the gases liberated during the remaining portion of the carbonization of coal charges are discharged only into the second gas main.

The gases produced during the charging of coal into coke oven chambers have a very high dust content. Tar separated out of such gases has a very high dust content which reduces the quality of the tar. The charging gases produced when dried and preheated coal is charged into an oven chamber are particularly heavily laden with dust.

It is known in the art to remove the charging gases and possibly also the gases liberated during the early stages of carbonization in an oven chamber through a separate gas main. These charging gases are passed through a wet precipitator before the gases are combined with distillation gases liberated during the remaining part of the carbonization process. When a special gas main is employed to conduct only charging gases, special action must be taken to keep the pressure of the gases in the gas main at a value which will prevent the entry of air into the gas main. When distillation gases are diverted into a charging gas main, in an arrangement of this type throughout an extended period of time, the dust-laden tar separated out of the gases is obtained together with tar which can be considered satisfactory. As a consequence, there is a decrease in the yield of satisfactory tar.

SUMMARY OF THE INVENTION

It is an object of the present invention to provide a method of operating a battery of coke ovens wherein charging gases laden with dust are removed only into a first gas main from the oven chamber during the charging of coal therein, particularly during the time when such oven chamber is charged with predried and preheated coal while the gases liberated in the oven chamber throughout the remainder of the carbonization period are withdrawn into only a second gas main and the gases withdrawn into each of the gas mains are sprayed with flushing liquor so that the second main provides a very high yield of usable tar by means of very simple and proven elements and methods.

According to the present invention, there is provided a method of operating a battery of coke ovens having individual coking chambers each communicating by way of separate and closable ascension pipes with two gas mains wherein the gases are sprayed with flushing liquor, charging gases from each individual coke oven chamber being fed into a first gas main throughout the charging of coal period and the gases liberated throughout the remainder of the carbonization time by the oven chamber being fed into the second gas main, the sprays in each gas main being sufficient to cool the gases therein which are continuously transferred from the first gas main to the second gas main and removed with flushing liquor from the second gas main, while only flushing liquor is removed from the first gas main for processing to recover clean tar.

More specifically, according to the present invention, there is provided a plurality of spaced-apart, side-by-side coke oven chambers each communicating through a closable ascension pipe with separate first and second gas mains extending along the battery of coke ovens, the steps including extracting charging gases into only the first gas main while charging coal into each coke oven chamber, spraying the charging gases within the first gas main with flushing liquor to cool the gases therein, extracting the gases liberated during carbonization of the coal charge in each coke oven chamber into only the second gas main throughout the carbonization period by each coke oven chamber, spraying the gases within the second gas main with flushing liquor to cool the gases therein, continuously transferring gases from the first gas main into the second gas main, removing flushing liquor evolving in the first gas main, and removing gases and flushing liquor evolving in the second gas main therefrom.

Tar is recovered from the flushing liquor removed from the second gas main through separation of the flushing liquor. Since gases laden with dust do not enter the second gas main, the tar is satisfactory. Therefore, substantially the entire yield of tar obtainable is recovered through separation of tar from the flushing liquor removed from the second gas main. After separation of the tar from the flushing liquor, the clear flushing liquor is reused to spray gases in the second gas main. In this way, the gas in the second main is cooled satisfactorily and most of the tar enters the flushing liquor in the second gas main.

The gas and flushing liquor removed from the second gas main are treated separately. After separation, the gases are supplied to a by-product plant or processed in some other way. Tar and solids are separated out of the flushing liquor discharged from the first gas main to obtain clear flushing liquor for reuse to spray gases in the first gas main. The tar yield from the separation of this flushing liquor has a relatively poor quality due to a high dust content. The high dust content is unavoidable because the charging gases are discharged into the first gas main. The total quantity of the tar yield from the flushing liquor discharged from the first gas main is low, particularly when care is taken to insure that most of the tar enters the flushing liquor within the first gas main during spraying of the gases therein.

Since gases from the oven chambers are discharged into the first gas main only during a brief period of time, i.e., during the charging of the individual coking chambers, care must be taken to insure that the first gas main is thoroughly scavenged by the gases discharged from the first gas main. The gases are, therefore, removed from the second gas main at a point along its length spaced some distance away from the point or each point where gases from the first gas main enter into the second gas main. Conveniently, gases are removed from the second gas main at a central location along the length of the main and there is a connection between the two gas mains at both ends of the coke oven battery where the gases from the first gas main enter and flow toward the center of the second gas main.

These features and advantages of the present invention as well as others will be more fully understood when the following description is read in light of the accompanying single FIGURE drawing which is a schematic illustration of a coking chamber for a battery of coke ovens together with apparatus for carrying out the method of the present invention.

In the drawing, there is illustrated a battery of coke ovens generally identified by the reference numeral 10. The battery of coke ovens includes, in the usual well known manner, a plurality of spaced-apart, side-by-side coke oven chambers 11. A charging car (not shown) is adapted to travel along the top of the battery of coke ovens to charge coal into the coke oven chambers. The coke oven chambers are charged one at a time with dried and preheated coal for carbonization in the coke oven chamber.

Gas collecting mains 12 and 13 extend along the battery of coke ovens 10 preferably by arranging one gas collecting main along each side of the battery. Each gas collecting main communicates with each coke oven chamber 11 through closable ascension pipes 14. For this purpose, each ascension pipe 14 includes a valve 14A which is actuated to selectively open and close the interconnection by the ascension pipe between the associated gas main and coke oven chamber. Nozzles, spaced along the length of each gas main, spray flushing liquor within the gas main to cool and saturate the gases therein. Two transfer pipes 15, one at each end of the battery of coke ovens, form a permanent interconnection between the two gas mains 12 and 13 for transferring gases from gas main 13 into gas main 12. The gases transferred by pipes 15 equalize the pressures within the gas mains.

Gases, liquids and solids are discharged from gas main 12 by line 16 to a by-product plant and thence to a liquid/gas separator 17. The liquids and solids recovered from separator 17 are fed into a decanting tank 18 from which relatively clear flushing liquor is discharged by line 19 to the nozzles for the flushing liquor sprays in gas main 12. Solids are removed from the base of the decanting tank 18 for disposal and other use. While the gases in gas main 13 freely pass through transfer pipes 15 into gas main 12 for removal through line 16, the solids and tar containing liquor within gas main 13 is removed separately by line 21 for discharge into a decanting tank 22. In the decanting tank, the tar-laden flushing liquor is separated and clear flushing liquor is fed by line 23 to the nozzles for spraying flushing liquor in gas main 13. Tar is discharged by line 24 from the base of the decanting tank 22.

In the method of operating a battery of coke ovens according to the present invention, during the period when a coke oven chamber is charged with predried and preheated coal, that coke oven chamber is connected via ascension pipe 14 to gas main 13 by opening the valve in the ascension pipe. During the charging period, a considerable volume of dust-laden charging gases produced in the oven chamber pass only into gas main 13. The dust content of the charging gases is washed out of the gases by the liquor sprays. Upon completion of the charging operation for the coke oven chamber, the valve in the ascension pipe coupling this chamber to gas main 13 is closed and the valve in the ascension pipe coupling the coke oven chamber to gas main 12 is opened throughout the remainder of the carbonization period by the oven chamber. The identical process is carried out for each coke oven chamber in the battery of coke ovens. Thus, it can be seen that gas main 13 receives a considerable quantity of dust while the majority of the tar produced during the carbonization process is fed into gas main 12. The tar in gas main 13 is substantially dust-free. This tar, together with circulating flushing liquor, is removed from the gas main by line 21.

Although each coke oven chamber is connected to the gas main 13 only during the charging period, the gas pressure within the gas main is maintained by equalization of the pressure between the two gas mains 12 and 13 because of their interconnection by transfer pipes 15 as described hereinabove.

It is important to insure that line 16 used to conduct gases, liquids and solids from gas main 12 is located at a remote point from the location of transfer pipes 15 so that there is a continuous flow of gases throughout the gas main 12. In this way, the temperature is maintained substantially constant, thus avoiding problems of expansion and contraction of the gas mains and associated pipes. Such expansion problems would otherwise be incurred. Moreover, the continuous flow of gases within the gas mains insures that the contents within the gas mains are properly removed and not allowed to become stagnant therein and undergo solidification. Thus, it is particularly advantageous to provide a transfer pipe 15 at each end of the battery of coke ovens and locate line 16 for communication with the gas main 12 at about its midpoint along the battery of coke ovens.

The apparatus described hereinbefore for carrying out the method of the present invention may be utilized to carry out carbonization of coal without preheating the coal before it is charged into a coke oven chamber. In this event, each oven chamber is permitted to communicate with both gas mains during the charging and the entire carbonization periods.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method for operating a battery of coke ovens including a plurality of spaced-apart, side-by-side coke oven chambers each communicating through a closable ascension pipe with separate first and second gas mains extending along the battery of coke ovens, wherein the improvement includes the steps of:

extracting charging gases into only said first gas main while charging coal into each coke oven chamber, spraying the charging gases within the first gas main with flushing liquor to cool the gases therein, extracting the carbonizing gases liberated during carbonization of the coal charge in each coke oven chamber into only said second gas main throughout the carbonization period by each coke oven chamber, spraying the carbonizing gases within the second gas main with flushing liquor to cool the gases therein, continuously transferring said charging gases from said first gas main into said second gas main, removing flushing liquor evolving in the first gas main therefrom, and removing gases and flushing liquor evolving in the second gas main therefrom.

2. The method of claim 1 including the further step of separating a tar constituent from the flushing liquor removed from the second gas main.

3. The method according to claim 2 including the further steps of recovering flushing liquor after said step of separating a tar constituent therefrom, and delivering the recovered flushing liquor for said step of spraying said carbonizing gases within the second gas main.

4. The method according to claim 1 including the further steps of treating the gases removed from the first gas main, and separately treating the flushing liquor removed from the first gas main.

5. The method according to claim 4 wherein said treating the gases removed from the second gas main includes processing the gases from the second gas main in a by-product plant.

6. The method according to claim 4 including the further steps of separating tar and solids from the flushing liquor removed from the second gas main, recovering flushing liquor after said step of separating tar and solids from the flushing liquor, and delivering the recovered flushing liquor for said step of spraying the charging gases within the first gas main.

7. The method according to claim 1 wherein said step of removing gases and flushing liquor includes removing gases from the second gas main at a gas-removal point spaced from the point where charging gases enter the second gas main from the first gas main.

8. The method according to claim 1 wherein said step of removing gases and flushing liquor includes removing gases from the second gas main at a central gas-removal point midway along the battery of coke ovens, and wherein said step of continuously transferring gas includes feeding charging gas from each of the opposite ends of the first gas main into the respective opposite ends of the second gas main.

9. The method according to claim 1 including the further steps of separating flushing liquor from the gas removed from the second gas main, cooling the gas after separation from the flushing liquor, and processing the cooled gas in a by-product plant.

* * * * *